United States Patent [19]

DeSimone

[11] 4,146,507

[45] Mar. 27, 1979

[54] NOVEL CYCLOHEXENE-3-NITRILES IN PERFUME COMPOSITIONS

[75] Inventor: Robert S. DeSimone, Middletown, N.Y.

[73] Assignee: Polak's Frutal Works, Inc., Middletown, N.Y.

[21] Appl. No.: 858,039

[22] Filed: Dec. 6, 1977

Related U.S. Application Data

[62] Division of Ser. No. 735,571, Oct. 26, 1976, abandoned.

[51] Int. Cl.[2] ..... C11B 9/00

[52] U.S. Cl. ..... 252/522; 260/465.9

[58] Field of Search ..... 252/522

[56] References Cited

U.S. PATENT DOCUMENTS

| | | | |
|---|---|---|---|
| 3,168,550 | 2/1965 | Blumeuthal | 260/464 |
| 3,714,220 | 1/1973 | Dahill, Jr. | 252/522 |
| 3,870,742 | 3/1975 | Klein | 260/464 |

OTHER PUBLICATIONS

Chem. Ab. 25, 2436-5, 1931.

Chem. Ab. 25, 4891-7, 1931

Steffen Arctauder, Perfume and Flavor, published by author, Montclair, N.J., vol. I, 764, 1969.

*Primary Examiner*—Veronica O'Keefe

*Attorney, Agent, or Firm*—William S. Alexander

[57] ABSTRACT

Novel cyclohexene-3 nitriles are disclosed as perfumery ingredients.

2 Claims, No Drawings

NOVEL CYCLOHEXENE-3-NITRILES IN PERFUME COMPOSITIONS

This is a division of application Ser. No. 735,571, filed Oct. 26, 1976, now abandoned.

This invention relates to novel cyclohexene nitriles and to their use as odor-enhancing components in perfume compositions.

BACKGROUND OF THE INVENTION

For many years, most of the chemicals employed in perfumery were derived from natural sources. While such materials are still highly desirable, they are often subject to the objection that their quality is not controllable and can vary considerably due to natural conditions and their supply is frequently uncertain due to political conditions in countries or areas of the world where they are found. For these reasons, in recent years, considerable effort has been directed toward preparation of synthetic odorants to reproduce or even improve on the odor of the natural products. It has also been found possible to produce entirely new odor effects by means of synthetic materials and, importantly, to prepare these at prices more attractive and more stable than those of natural derivatives.

SUMMARY OF THE INVENTION

The invention comprises the novel compounds 3,5-dimethyl-3-cyclohexene nitrile, 2,4-dimethyl-3-cyclohexene nitrile, mixtures of the said 2,4- and 3,5-dimethyl nitriles, 2,4,6-trimethyl-3-cyclohexene nitrile, 3,5,6-trimethyl-3-cyclohexene nitrile and mixtures of said 2,4,6-trimethyl and 3,5,6-trimethyl nitriles. The invention also contemplates the use of said compounds and mixtures in perfume compositions.

The novel compounds of the invention are readily synthesized via the well-known Diels-Alder reaction using 2-methyl-1,3-pentadiene and either acrylonitrile or crotonitrile via the following general reaction:

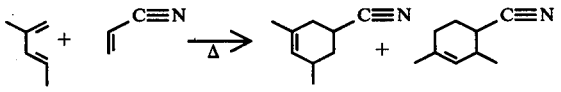

Use of crotonitrile in place of acrylonitrile produces the mixture of 2,4,6- and 3,5,6-trimethyl-3-cyclohexene nitriles.

Surprisingly, it has been found that the analogous condensation products 1,2,4- and 1,3,5-trimethyl-3-cyclohexene nitrile prepared from 2-methyl-1,3-pentadiene and methacrylonitrile have very harsh, camphoraceous, chemical odors. Likewise, 1-methyl-3-cyclohexene nitrile is known to have a camphoraceous odor which is not useful to perfumers (U.S. Pat. No. 2,217,632).

The nitriles of this invention can be employed as mixtures in the isomer proportions obtained from the respective reactions noted hereinabove or these isomer mixtures can be fractionated to recover individual isomers which can be used as such or blended with each other in other proportions. The isomers or blends thereof can be employed as perfumes per se in a suitable carrier or they can be used in combination with other ingredients in perfumes having woody, cinnamic notes. The amount present in a perfume can be about 0.01 to about 6%, preferably about 0.1 to 4% of either an individual nitrile or of an isomer mixture based on the weight of the perfume composition.

Compared to many compounds, both natural and synthetic, which are widely used in perfumery, such as certain aldehydes, alcohols, epoxides and the like, the nitriles of the present invention possess a relatively high degree of stability to acid or basic conditions, as well as to oxidative and thermal effects. This stability lends special utility in fragranced products where the aroma of a perfume not containing stable components would not maintain its integrity in such bases as detergents, cleaners, soaps, and personal care products. In these product bases, many fragrance compositions designed specifically for colognes or fine perfumes would not exhibit satisfactory odor integrity either prior to or during use.

The following examples serve to illustrate embodiments of the invention as it is now preferred to practice it. It will be understood that these examples are illustrative and this invention would not be restricted other than by the appended claims.

EXAMPLE 1

Preparation of Mixed 3,5-Dimethyl- and 2,4-Dimethyl-3-Cyclohexene Nitriles

A one-gallon stainless steel autoclave equipped with a steam jacket and magnetically driven turbine-type stirrer was charged with 492 g. of 50% purity 2-methyl-1,3-pentadiene containing about 25% of 2-methyl-2,4-pentadiene and approximately 25% of mixed C-6 monoolefinic alcohol and C-8 cyclic ethers (see S. A. Ballard et al., *J. Amer. Chem. Soc.*, Vol. 72, 5734 (1950) in which the synthesis of 2-methyl-1,3-pentadiene with its by-products is described). At the same time was charged 212 g. of acrylonitrile. The autoclave was sealed and the contents maintained between 90 and 123° C. with stirring for 3 hours and then cooled. The mixture was withdrawn from the autoclave (693 g.) and charged to a one-liter still flask. Rectification was performed on a 23 mm. by 4-foot spinning band distillation column to yield the following fractions (reflux ratio 15:2; 3 mm. Hg):

| Fraction | Temperature Time (Hr.) | Temperature Pot (° C.) | Vapor (° C.) | Weight (g.) | $N_D^{21}$ |
|---|---|---|---|---|---|
| 1 | 0.67 | 64 | 26 | 25 | |
| 2 | 0.83 | 65 | 27 | 23 | |
| 3 | 1.09 | 74 | 38 | 26 | |
| 4 | 1.29 | 73 | 58 | 18 | |
| 5 | 1.42 | 73 | 62 | 9 | |
| 6 | 1.52 | 73 | 64 | 9 | |
| 7 | 1.60 | 73 | 65 | 9 | |
| 8 | 1.86 | 73 | 66 | 23 | |
| 9 | 2.11 | 73 | 65 | 26 | 1.4677 |
| 10 | 2.37 | 73 | 66 | 26.5 | |
| 11 | 2.69 | 74 | 67 | 26.5 | 1.4690 |
| 12 | 2.94 | 74 | 67 | 28 | |
| 13 | 3.17 | 74 | 67 | 25.5 | 1.4693 |
| 14 | 3.33 | 74 | 67 | 27 | |
| 15 | 3.61 | 74 | 67 | 27.5 | 1.4703 |
| 16 | 3.89 | 76 | 67 | 27.5 | |
| 17 | 4.11 | 79 | 67 | 25 | |
| 18 | 4.44 | 94 | 67 | 25 | |
| 19 | 4.52 | 128 | 65 | 7 | |

Gas chromatographic analysis (6-foot by ¼-inch stainless steel column packed with 20% Carbowax 20M on Chromasorb W, He flow 60 ml. per minute) showed two major product peaks at R.F. 19.5 cm. and 20.4 cm. in a respective ratio of 1.12. A minor peak at 19.0cm. was present at 2.4% relative to the major product peaks — the chart speed was 30 inches per hour. The rectified fractions 1 and 2, when combined showed 2.6% product peaks, combined fractions 3 to 5 showed 27.2% and combined fractions 6 to 19 showed 94.2% of the two major products. Analysis of combined fractions 8 to 18 showed 10.17% Kjeldahl nitrogen-theory 10.38%.

The odor of combined fractions 8 to 18 has a strong, green, cuminic note with a herbal, cinnamic, woody background. The dry-out odor on a blotter after 24 hours is strong, warm, woody.

The nitriles of the example can be used in woody perfume compositions, such as sandalwood, patchouli, vetivert, oakmoss, cedarwood, etc., and its primary effect is as a base modifier in such perfume oils. They can also be effective when blended with florals, such as ylang, jasmin, tuberose, muguet and rose. They can also be used to modify topnotes, particularly in citrus or herbal citrus compositions.

EXAMPLE 2

Green, Woody, Spicy Perfume

The following perfume composition incorporates the mixed 3,5-dimethyl- and 2,4-dimethyl-3-cyclohexene nitriles:

| Component | Parts by Weight |
|---|---|
| Base Notes | |
| Cedarwood Oil | 200 |
| 1,1,2,3,3,6-Hexamethyl-5-Acetyl Indane | 35 |
| 1,1,2,4,4,7-Hexamethyl-6-Acetyl Tetralin | 10 |
| 3,5-Dimethyl and 2,4-Dimethyl-3-Cyclohexene Nitriles* | 30 |
| Isobornyl Acetate | 160 |
| Hexyl Cinnamic Aldehyde | 60 |
| Styralyl Acetate | 70 |
| Alpha-Terpineol | 70 |
| Top Notes | |
| 2-Ethyl Pyridine | 1 |
| C.P. Formate (IFF Register) | 5 |
| 1,4-Cineole | 25 |
| 1,8-Cineole | 25 |
| Eugenol | 20 |
| Linalool | 40 |
| Linalyl Acetate | 40 |
| Methyl Hexyl Ketone | 4 |
| Lavandin Oil | 40 |
| Spearmint Oil | 10 |
| Modifiers | |
| Lemon Oil Messina | 55 |
| Phenyl Ethyl Alcohol | 50 |
| Hydroxy Citronellal | 50 |
| Total | 1000 |

*Blend of fractions 6 to 19 of Example 1

EXAMPLE 3

Preparation of 2,4,6-Trimethyl and 3,5,6-Trimethyl-3-Cyclohexene Nitriles

An autoclave as described in Example 1 was charged with 368 g,. of 50% 2-methyl-1,3-pentadiene, as in Example 1, and 201 g. of crotonitrile. The mixture was heated with stirring at about 115° C. for a total of 25 hours. After cooling, 522 g. of crude reaction mixture were recovered from the autoclave. Rectification was performed on a one-inch diameter by one-foot, 7-plate Goodloe column:

| Fraction | Time (hr.) | Pot (° C.) | Vapor (° C.) | Vacuum (mm. Hg.) | Weight (g.) |
|---|---|---|---|---|---|
| | | 23 | 14 | 20 | |
| | 1.40 | 70 | 15 | 15 | |
| 1 | 2.98 | 95 | 56 | 6.5 | 61.3 |
| 2 | 3.73 | 101 | 65 | 5 | 26.6 |
| 3 | 4.33 | 109 | 75 | 4 | 21.1 |
| 4 | 4.68 | 105 | 58 | 1.3 | 16.6 |
| 6 | 6.10 | 98 | 62 | 1.5 | 8.6 |
| 7 | 6.63 | 102 | 58 | 1 | 9.4 |
| 8 | 7.05 | 109 | 56 | 1 | 8.9 |
| 9 | 9.05 | 130 | 56 | 1 | 9.9 |
| 10 | 9.91 | 165 | 60 | 1.1 | 9.7 |
| 11 | 11.51 | 205 | 50 | 0.5 | 8.1 |

Fractions 6 through 9, when combined, had a warm, spicy, fresh character with a soft, green background. The dry-out after 24 hours is mild, woody, cinnamic.

The product of this example can be used in spicy fragrance compositions, such as cinnamon, ylang, lilac, carnation and jasmin. It can also be effectively blended with the balsamic resin group, as well as the more woody class of materials, such as sandalwood, vetivert and patchouli oils.

EXAMPLE 4

Woody, Balsamic, Citrus Fragrance

| Component | Parts by Weight |
|---|---|
| Base Notes | |
| Coumarin | 150 |
| 2,4,6-Trimethyl and 3,5,6-Trimethyl-3-Cyclohexene Nitriles* | 20 |
| Heliotropin | 30 |
| Musk Ambrette | 10 |
| Myrrh Resin | 10 |
| Benzoin, 50% Diethyl Phthalate | 40 |
| Styrax Resin | 20 |
| Ethyl Vanillin | 25 |
| Amyris Oil | 40 |
| Top Notes | |
| Citral Dimethyl Acetal | 70 |
| Tetrahydro Linalool | 90 |
| Cuminyl Alcohol | 10 |
| Dibenzyl Ether | 200 |
| Linalool | 70 |
| Modifiers | |
| Benzyl Acetate | 7.5 |
| Hexyl Cinnamic Aldehyde | 7.5 |
| Orange Oil | 85 |
| Lemon Oil | 85 |
| Beta-Methyl Naphthyl Ketone | 30 |
| Total | 1000 |

*Fractions 6 through 9 of Example 3

What I claim and desire to protect by Letters Patent is:

1. A perfume composition containing an olfactory amount of a compound selected from the class consisting of
   (a) 2,4-dimethyl cyclohexene-3-nitrile;
   (b) 3,5-dimethyl cyclohexene-3-nitrile;
   (c) 2,4,6-trimethyl cyclohexene-3-nitrile; and
   (d) 3,5,6-trimethyl cyclohexene-3-nitrile and a suitable carrier.

2. A perfume composition of claim 1 wherein the compound is present in amount of about 0.01 to 6% of the total weight of the perfume.

* * * * *

UNITED STATES PATENT AND TRADEMARK OFFICE

CERTIFICATE OF CORRECTION

PATENT NO. : 4,146,507

DATED : March 27, 1979

INVENTOR(S) : Robert S. DeSimone

It is certified that error appears in the above-identified patent and that said Letters Patent are hereby corrected as shown below:

Fraction 5 has been omitted from the table in Example 3. Col. 4, line 10, insert fraction 5. It should read as follows:

| | | | | | |
|---|---|---|---|---|---|
| 5 | 5.78 | 92 | 62 | 2 | 12.4 |

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*